US005197428A

United States Patent [19]

Hornby

[11] Patent Number: 5,197,428

[45] Date of Patent: Mar. 30, 1993

[54] FUEL INJECTOR SURROUNDING INTAKE VALVE STEM

[75] Inventor: Michael J. Hornby, Williamsburg, Va.

[73] Assignee: Siemens Automotive L.P., Auburn Hills, Mich.

[21] Appl. No.: 925,709

[22] Filed: Aug. 4, 1992

[51] Int. Cl.[5] ..... F02M 57/04; F01L 9/04

[52] U.S. Cl. ..... 123/296; 123/90.11; 239/585.3

[58] Field of Search ..... 123/507, 296, 90.11; 239/585.3

[56] References Cited

U.S. PATENT DOCUMENTS 2,809,621 10/1957 Layne ..... 123/296
3,704,694 12/1972 Gilewski et al. ..... 123/296
3,812,829 5/1974 McCormick ..... 123/296
4,020,803 5/1977 Thuren et al. ..... 123/296
4,058,091 11/1977 Tanahashi ..... 123/296
4,539,950 9/1985 Schaich ..... 123/296
5,022,357 6/1991 Kawamura ..... 123/90.11
5,119,772 6/1992 Kawamura ..... 123/90.11

*Primary Examiner*—E. Rollins Cross
*Assistant Examiner*—Thomas N. Moulis
*Attorney, Agent, or Firm*—George L. Boller; Russel C. Wells

[57] ABSTRACT

An electromagnetic fuel injector has a tubular non-magnetic body defined by radially inner and outer side walls bounding an annular shaped interior which contains a tubular solenoid coil and an annular valve element that is operated by said solenoid coil to open and close the fuel injector. The radially inner wall bounds a central through-hole in the body that allows the stem of an engine intake valve to pass through the fuel injector, thereby enabling the fuel injector to be mounted on the manifold directly over the valve head.

13 Claims, 1 Drawing Sheet 20
68
67
26
10
12
69
24
48
50
52
40
28
44
59
38
53
46
42
47
36
34
54
55
32
58
60
57
61
62
14
65
64
63
30
70
18
16
22

FUEL INJECTOR SURROUNDING INTAKE VALVE STEM

FIELD OF THE INVENTION

This invention relates generally to internal combustion engines, and specifically to the mounting of a fuel injector on the engine.

BACKGROUND AND SUMMARY OF THE INVENTION

It is known to mount an electromechanical fuel injector on an engine intake manifold runner to direct the fuel injections toward the head of the intake valve that controls the introduction of combustible air/fuel mixture into a combustion chamber space (i.e., cylinder) that is served by the runner. Directing fuel injections directly against the head of an engine intake valve is typically deemed desirable because it avoids wetting the surrounding manifold or runner wall and because it promotes better fuel atomization due to the relatively higher temperature of the valve head when the engine is running. Generally speaking, the fuel injector's nozzle is located at a distance from the valve head, and it and/or or the accommodations required for mounting it may protrude into the airflow sufficiently to create some restriction on the airflow. If the straight line distance between the fuel injector's nozzle and the target on the valve head is not coaxial with the fuel injector's axis, the fuel injector is constructed to deliver what is sometimes referred to as a 'bent stream' injection (meaning that the direction of injection is not coaxial with the fuel injector's axis) so that the injections will be directed to the intended target.

The present invention relates to a novel arrangement for mounting a fuel injector on an engine, particularly in its association with an engine intake valve. The invention allows the fuel injections to be directed at the intake valve without having to incorporate a bent stream feature into the fuel injector. The invention also provides a novel association of an electromechanical fuel injector with an engine intake valve that can be very useful in packaging the fuel injector in an engine. Furthermore, it may impose less restriction on airflow that certain other fuel injector mountings. These, along with further advantages, features, and benefits of the invention will be seen in the ensuing description and claims which are accompanied by a drawing. The drawing discloses a presently preferred embodiment of the invention according to the best mode contemplated at this time for carrying out the invention.

DETAILED DESCRIPTION OF A PREFERRED EMBODIMENT

Figure 1:
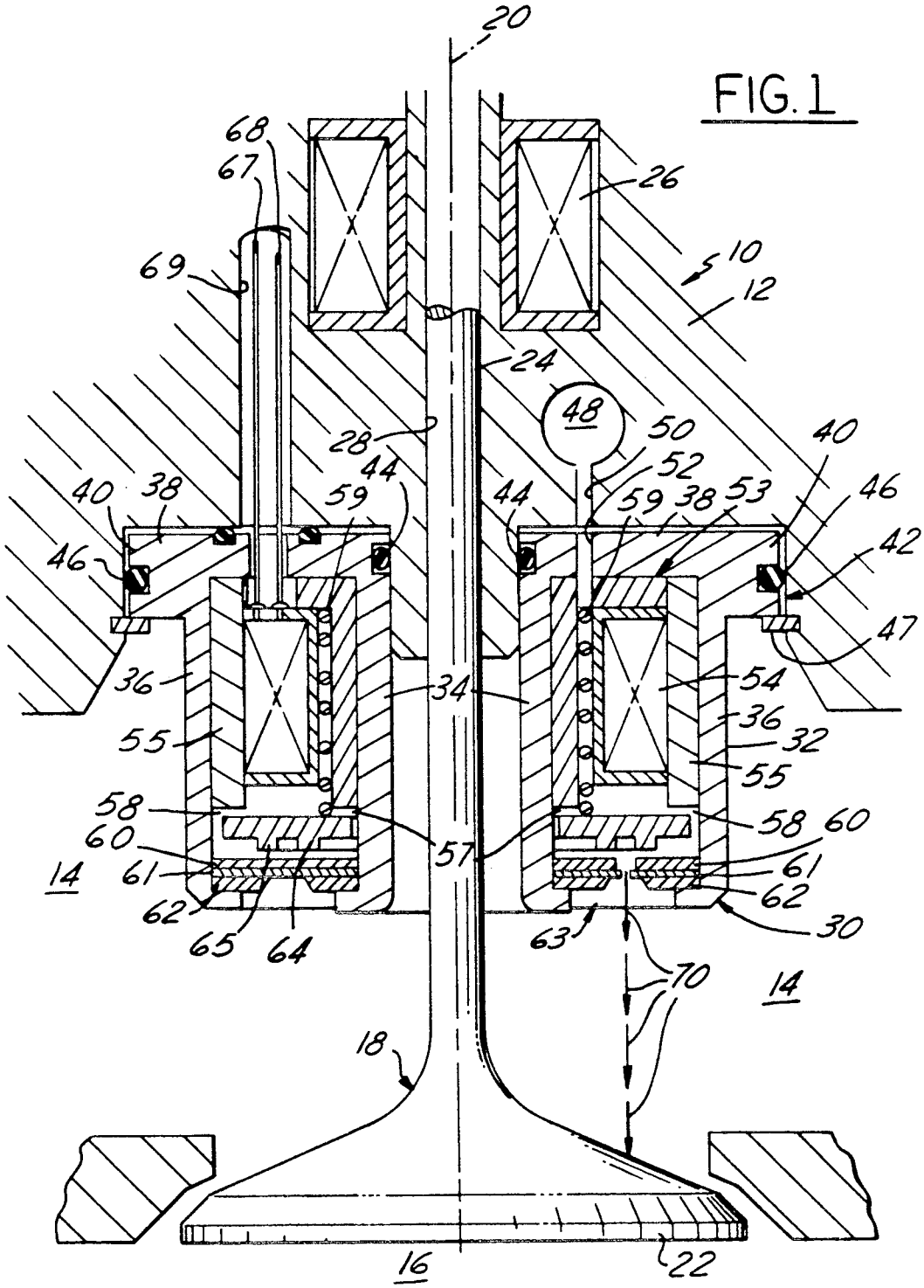
FIG. 1 shows a longitudinal cross sectional view through a portion of an internal combustion engine's intake system in the vicinity of one of its intake valves, including the incorporation of a fuel injector according to principles of the invention.

FIG. 1 shows a portion of an internal combustion engine 10 comprising an intake manifold 12 providing an intake passage 14 via which combustion air is conveyed to individual combustion cylinders, such as a cylinder 16 that is cooperatively defined by a cylinder head 17 and a cylinder block (not appearing in FIG. 1). The entrance to cylinder 16 from intake passage 14 is controlled by an intake valve 18 having an axis 20 along which the valve is reciprocated to open and close the entrance to the cylinder. FIG. 1 shows a partially open condition of the entrance for illustrative purposes.

Intake valve 18 has a head 22 and a stem 24 each of which is symmetric about axis 20. Controlled reciprocation of intake valve 18 is performed by a tubular solenoid coil 26 that is part of an electronic valve timing (EVT) system which controls the opening and closing of the individual intake valves. Solenoid coil 26 is mounted on manifold 12 so that its own axis is coincident with axis 20. Intake valve 18 is guided for its reciprocal motion by a suitable guide structure 28 in intake manifold 12. This much of the Detailed Description represents known engine construction.

In accordance with principles of the invention, an electromechanical fuel injector 30 is mounted on manifold 12 for injecting fuel directly toward valve head 22. Fuel injector 30 comprises a tubular body 32 having concentric inner and outer cylindrical side walls 34, 36 that are bridged at one end by an annular end wall 38. A thick circular lip 40 extends around the outside of body 32 at that same end, and that same end is received in an annular recess 42 in manifold 12. 0-ring seals 44 and 46 are disposed in respective grooves extending around the inside and outside at that same end of body 32 for sealing the body to the recess. A retaining ring 47 inserted into a groove in the side of the recess serves to retain fuel injector 30 in the recess.

Pressurized liquid fuel is served to fuel injector 30 by means of a fuel main passageway 48 in manifold 12. A smaller branch 50 conveys the fuel from passageway 48 to a fuel inlet 52 of the fuel injector.

Internally, fuel injector 30 comprises a solenoid 53 which includes a tubular bobbin-mounted coil 54 and a stator 55, both stationarily mounted within body 32. It further includes an annular armature disk valve member 56 that confronts stator 55 at radially inner and outer annular working gaps 57, 58 respectively. A helical coil spring 59 is disposed to act between end wall 38 and armature disk valve member 56 to bias the armature disk valve member away from the stator. Immediately below the armature disk valve member is annular nozzle structure that closes the annular space between walls 34 and 36 at the end of body 32 opposite end wall 38. This nozzle structure comprises a valve seat member 60, an orifice disk member 61, and a back-up member 62 that form a sandwiched stack which is sealed and secured to body 32.

FIG. 1 shows armature disk valve member 56 spaced slightly from valve seat member 60 for purposes of illustration. Members 60, 61, and 62 have respective aligned openings that collectively form one or more apertures for the nozzle from which fuel is injected when the fuel injector is operated open. One such aperture is shown in FIG. 1 and can be seen to be eccentric to axis 20. Additional such apertures may be provided at various locations around the circular extent of the nozzle structure.

The lower face of armature disk valve member 56 comprises inner and outer sealing rings 64, 65 respectively for abutting the upper face of seat member 60 radially inwardly and outwardly respectively of the nozzle apertures when the fuel injector is operated closed.

Electrical leads 67, 68 from solenoid coil 54 are brought out from the fuel injector through a hole 69 in manifold 12 for connection to a control circuit (not shown).

When solenoid coil 54 is not being energized, spring 59 forces rings 64 and 65 of armature disk valve member 56 against valve seat member 60 to close aperture 63. When it is being energized, the magnetic force acting across working gaps 57, 58 overpowers the spring force to unseat armature disk valve member 56 from seat member 60, thereby opening aperture 63. Fuel is now directed to valve head 22 along a path generally indicated by the arrows 70 because nozzle aperture 63 is constructed and arranged to inject fuel axially of the fuel injector parallel to axis 20. Body 32 is a non-magnetic stainless steel so that the magnetic flux is conducted across the working gaps.

Solenoid coil 26 is energized and de-energized in suitably timed relation to the position of the piston (not shown) in cylinder 16 to open and close intake valve 18, and solenoid coil 54 is likewise energized and de-energized in suitably timed relation to the opening and closing of intake valve 18. Typically, the solenoid coils are under the jurisdiction of an engine management computer.

Since valve stem 24 passes from head 22 through the tubular shaped fuel injector to an operative coupling with solenoid coil 26, an installation utilizing principles of the invention may offer certain packaging advantages for certain engines, an important consideration when the engines are used as powerplants of automotive vehicles. Principles also provide for the possibility of directing fuel directly onto the valve head over a relatively short distance in a stream or streams parallel to the fuel injector's axis, and with less disruption of the air flow than in certain other installations.

While a presently preferred embodiment of the invention has been illustrated and described, it should be appreciated that principles are applicable to other embodiments falling within the scope of the following claims.

What is claimed is:

1. An internal combustion engine comprising an intake valve that is reciprocated linearly along its own axis for controlling the introduction of combustible air-fuel mixture from an intake system into a combustion chamber space, and an electromechanical fuel injector disposed to inject fuel into said intake system toward said intake valve, said fuel injector comprising a tubular solenoid coil that is disposed around its own axis and that is electrically energized and de-energized to control fuel injections from said fuel injector, characterized in that said axis of said solenoid coil and said axis of said intake valve are disposed on a co-axis.

2. An internal combustion engine as set forth in claim 1 characterized further in that said fuel injector has nozzle structure from which injected fuel leaves the fuel injector, said nozzle structure comprises an annulus surrounding said co-axis, and said annulus contains one or more fuel injecting apertures disposed eccentric to said co-axis.

3. An internal combustion engine as set forth in claim 2 characterized further in that said fuel injector comprises within its interior an annular shaped valve element that is reciprocated axially in response to the energizing and de-energizing of said solenoid coil.

4. An internal combustion engine as set forth in claim 2 characterized further in that each of said one or more fuel injecting apertures is constructed and arranged to inject fuel generally along a direction that is parallel to said co-axis.

5. An internal combustion engine as set forth in claim 1 characterized further in that said intake valve is reciprocated by the energizing and de-energizing of a further tubular solenoid coil having its own axis, and the axis of said further tubular solenoid coil is also disposed on said co-axis.

6. An internal combustion engine as set forth in claim 5 characterized further in that said intake valve comprises a head and a stem, and said stem passes from said head through said first-mentioned solenoid coil to an operative coupling with said further solenoid coil.

7. An internal combustion engine as set forth in claim 6 characterized further in that said fuel injector comprises one or more fuel injecting apertures each of which is disposed eccentric to said co-axis and is constructed and arranged to inject fuel generally along a direction that is parallel to said co-axis and toward said intake valve head.

8. An internal combustion engine comprising an intake valve that has a head and a stem and that is reciprocated linearly along its own axis for controlling the introduction of combustible air-fuel mixture from an intake system into a combustion chamber space, and an electromechanical fuel injector disposed to inject fuel into said intake system toward said intake valve, said fuel injector comprising a tubular solenoid coil that is disposed around its own axis and that is electrically energized and de-energized to control fuel injections from said fuel injector, characterized in that said intake valve stem passes from said head through said solenoid coil to an actuator that reciprocates said intake valve.

9. An internal combustion engine as set forth in claim 8 characterized further in that said fuel injector has nozzle structure from which injected fuel leaves the fuel injector, said nozzle structure comprises an annulus surrounding said valve stem and said annulus contains one or more fuel injecting apertures disposed eccentric to said stem.

10. An internal combustion engine as set forth in claim 9 characterized further in that said fuel injector comprises within its interior an annular shaped valve element that is reciprocated axially in response to the energizing and de-energizing of said solenoid coil.

11. An internal combustion engine as set forth in claim 8 characterized further in that said actuator comprises a further tubular solenoid coil having its own axis, and the axes of said first-mentioned solenoid coil, of said further solenoid coil, and of said intake valve are disposed on a co-axis.

12. An internal combustion engine comprising an intake valve that controls the introduction of combustible air-fuel mixture from an intake system into a combustion chamber space and that is actuated by the electrical energization and de-energization of a first tubular solenoid coil that is disposed about its own axis, and an electromechanical fuel injector disposed to inject fuel into said intake system toward said intake valve, said fuel injector comprising a second tubular solenoid coil that is disposed around its own axis and that is electrically energized and de-energized to control fuel injections from said fuel injector, characterized in that said axis of said first solenoid coil and said axis of said second solenoid coil are disposed on a co-axis.

13. An electromagnetic fuel injector comprising a tubular body defined by radially inner and outer side walls bounding an annular shaped interior which contains a tubular solenoid coil and an annular valve element that is operated by said solenoid coil to open and close the fuel injector, said radially inner wall bounding a central through-hole in said body.

* * * * *